United States Patent [19]

Nelson

[11] 4,149,656

[45] Apr. 17, 1979

[54] DISHWASHER ADDITIVE DISPENSING APPARATUS HAVING A MOVABLE MEASURING CUP

[75] Inventor: Thomas E. Nelson, Anchorage, Ky.

[73] Assignee: General Electric Company, Louisville, Ky.

[21] Appl. No.: 798,932

[22] Filed: May 20, 1977

[51] Int. Cl.[2] ..... G01F 11/10

[52] U.S. Cl. ..... 222/70; 134/93; 222/363

[58] Field of Search ..... 222/70, 129, 164, 166, 222/167, 427, 516, 517, 531, 532, 454, 353, 356, 363, 369; 134/56 D, 57 D, 57 DL, 58 D, 58 DL, 93, 95, 100, 101; 68/17 R, 207

[56] References Cited

U.S. PATENT DOCUMENTS

| | | | |
|---|---|---|---|
| 3,212,675 | 10/1965 | Krzewina | 222/70 |
| 3,220,607 | 11/1965 | Seal | 222/70 X |
| 3,828,975 | 8/1974 | Robandt et al. | 222/70 |
| 3,980,206 | 9/1976 | Hancock | 134/93 |

*Primary Examiner*—Robert J. Spar
*Assistant Examiner*—Fred A. Silverberg
*Attorney, Agent, or Firm*—Bruce A. Yungman; Radford M. Reams

[57] ABSTRACT

A dishwashing apparatus having a dispenser operable at a preselected time in the dishwashing cycle for dispensing a treating liquid such as a rinse additive. The dispenser is arranged so as to measure in a measuring cup a preselected quantity of additives as an incident of moving the dishwasher door between opened and closed positions and to dispense the preselected quantity at the proper time in the wash cycle. The measuring cup for the additive is pivotally mounted within the dispenser and is pivoted from a position submerged in the liquid additive when the dishwasher door is opened in the horizontal plane, and above the liquid additive level when the dishwasher door is closed in the vertical plane, to a position so as to discharge the liquid by gravity into a discharge conduit. The discharge conduit additive receiving opening is located above the level of the liquid additive at all door positions and conveys the liquid additive by gravity into the washing chamber. The pivoting of the measuring cup is effected at the desired preselected time in the dishwashing cycle.

6 Claims, 5 Drawing Figures

DISHWASHER ADDITIVE DISPENSING APPARATUS HAVING A MOVABLE MEASURING CUP

CROSS REFERENCE TO RELATED MATTER

This application is related to commonly assigned copending patent application Ser. No. 798,974 filed May 20, 1977.

BACKGROUND OF THE INVENTION

The instant invention relates to washing apparatus and, in particular, to dispensers for dispensing a preselected quantity of liquid additive at a preselected time into washing liquid during a washing operation.

Conventional dishwashers effect cleaning by means of a preselected timed sequence of wash and rinse cycles in which different additives are introduced to the dishwashing chamber. Thus, detergent may be dispensed at different times during the wash cycle and rinse additives to provide improved rinsing of the washed dishes may be dispensed during the rinse cycle. Automatic dispensers which operate in preselected time sequence have been provided in the past to effect the dispensing operation. However, because of the conditions under which such dispensers operate, it is desirable to provide such dispensers with a minimum number of moving parts along with substantially clog-free construction. Likewise, for competitive reasons it is desirable to provide such dispensing structures which are extremely simple and economical in construction while still providing positive dispensing with minimum maintenance over long periods of use of the apparatus and elimination of any possibility of leakage.

One dispenser for a water conditioner for use in a dishwasher is shown and described in U.S. Pat. No. 3,029,826 of Donald E. Fink et al. In this dispenser a measuring cup is filled with a preselected quantity of liquid additive on opening and closing of the dishwasher door. The liquid additive is then discharged at the appropriate time in the dishwashing cycle by opening a valve to allow the liquid additive to flow by gravity from the measuring cup into an exit port and thence into the washing chamber of the dishwasher. This particular structure has the disadvantage of requiring many moving parts and particularly, moving parts in a valve system which ultimately result in wear and thus leakage of the liquid additive into the washing chamber prior to the time required in the preselected wash cycle. For example, a rinse additive could thus leak into the washing chamber during the wash cycle and be discharged from the dishwasher prior to the rinse cycle even beginning.

Still another automatic dispenser for a dishwasher is described in U.S. Pat. No. 3,828,975 of William F. Robandt, II et al. The dispenser disclosed in this patent is arranged to supply a quantity of liquid additive as an incident of moving the dishwasher door between opened and closed positions and to dispense the quantity subsequently at the desired time in the dishwashing cycle. The quantity of liquid additive is not truly preselected as the quantity supplied to the measuring means varies with the quantity of liquid additive in the reservoir. This roughly measured quantity of liquid additive is then discharged by a pressure producing means into the washing chamber. While this construction eliminates premature leakage of liquid additive into the washing chamber, it does not precisely measure a preselected quantity of additive and thus of necessity is wasteful in that it must supply a minimum quantity of additive sufficient to effect the desired result when the additive reservoir is nearly empty and therefore, due to the design, supplies an excess of additive when the additive reservoir contains more than the minimum quantity of additive to be operable. Furthermore, leakage from the washing chamber into the measuring chamber could also result in dilution of the liquid additive thereby resulting in a further wasteful oversupply of liquid additive to the washing machine chamber on that cycle and possibly diluting the liquid additive during subsequent wash loads so as to result in insufficient additive being supplied when the additive level in the reservoir approaches its minimum.

SUMMARY OF THE INVENTION

The present invention involves an improved dispensing structure for dispensing liquid additives into a washing chamber of a washing apparatus wherein the quantity of liquid additive dispensed is precisely measured and is dispensed at a preselected time in the washing cycle. Premature leakage of the liquid additive into the washing chamber is impossible with the instant apparatus as is leakage from the washing chamber.

In its preferred form, the automatic dispenser of the instant invention is designed for installation in the interior of a bottom-hinged door and comprises a main body part attached to the inner face of the door which acts as a liquid additive reservoir. This reservoir is occasionally supplied by the user with liquid additive through an inlet port which extends through the inner face of the door, preferably when the door is in an open, generally horizontal position. A threaded closure or other cap-like device keeps the inlet port closed when liquid additive is not being replenished.

Within the main body part or reservoir, a measuring cup is attached to an arm which pivots about a point remote from the measuring cup. When the door to the washing apparatus is in the open, substantially horizontal position, the measuring cup is in a position submerged in the liquid additive in the reservoir. When the door of the washing machine is moved to the closed, substantially vertical position, the liquid additive flows by gravity to the now lower portion of the main body part or reservoir leaving the measuring cup filled with a preselected quantity of liquid additive in the reservoir and in the same spacial relationship with the door as when the door was in an open position.

At the preselected time in the wash cycle, the measuring cup is rotated by the attached arm about the remote point so as to move and tip the measuring cup and thus discharge a preselected quantity of liquid.

BRIEF DESCRIPTION OF THE DRAWINGS

Other features and advantages of the invention will be apparent from the following description taken in conjunction with the accompanying drawings wherein.

DETAILED DESCRIPTION OF THE INVENTION

In the following detailed description of the instant invention, the dispenser will be described as being a dispenser of a rinse cycle additive but it is readily apparent that the invention is equally applicable to the dispensation of detergents or any other such additives. Likewise, the dispenser will be described in association with a dishwasher although it could have equal utility in association with any washing device.

Figure 1:
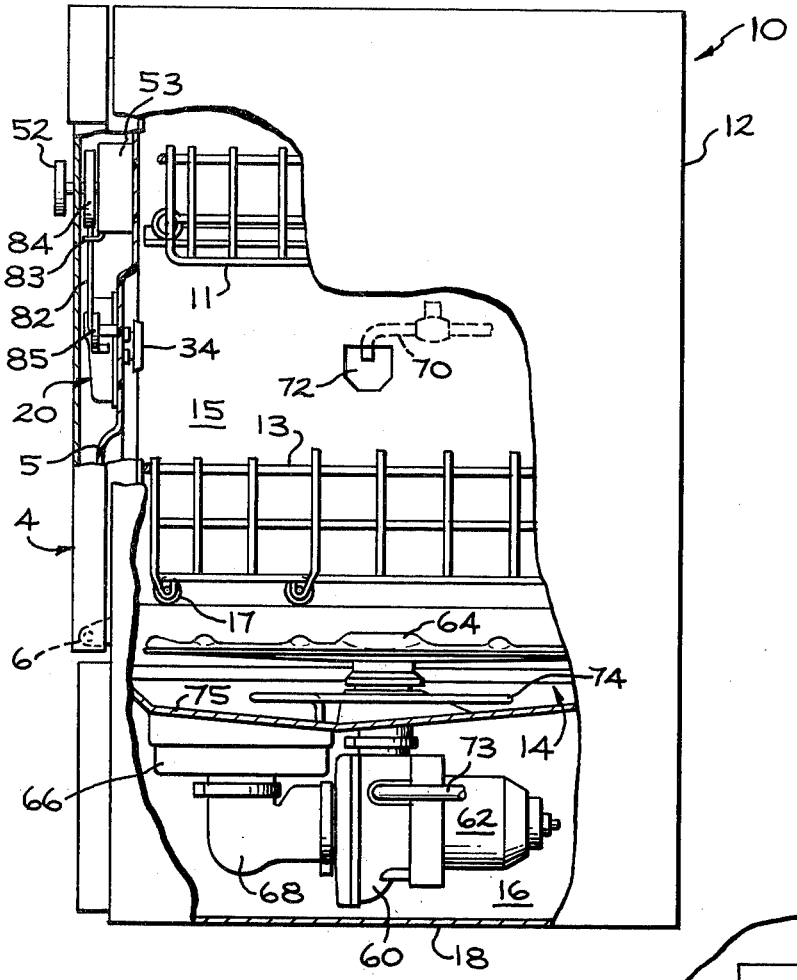
FIG. 1 is a side sectional elevational view of a dishwasher having a dispenser structure embodying the invention, with portions of the dishwasher cut away to facilitate illustration thereof.

FIG. 1 shows somewhat schematically an automatic dishwasher of a conventional domestic type. The dishwasher 10 includes an outer cabinet 12, and a tub 14 which forms the washing compartment 15 and a machinery compartment 16. The walls 18 of the machinery compartment are formed of metal. The tub 14 may be formed as a one piece structure of plastic or other heat deformable material, such as polypropylene, and is supported on the side walls 18 of the machinery compartment.

Racks 11 and 13 for supporting articles to be washed are mounted within the tub 14. The racks are mounted on rollers, one of which is shown at 17, for permitting the racks to be pulled outwardly of the cabinet to facilitate loading of articles therein. The tub is provided with a bottom-hinged door 4 which is pivotable between its substantially vertical closed position and an open position in which the inner panel 5 of the door is substantially horizontal. The door is supported on hinges 6. As is well known, the dish racks are arranged to be drawn from the tub when the door 4 is open.

In the machine compartment 18, there is disposed a pump 60 which is driven by an electric motor 62. The pump is connected by a conduit to supply water to the reaction type spray arm 64 which is arranged to eject a spray of washing or rinsing fluid over the articles in the dishwasher in a conventinal manner. Water flows to a sump 66 from which it is returned to the pump through a conduit 68. Water for operation of the dishwasher is supplied as needed from a regular household water line, indicated at 70. The water is delivered into a fill funnel 72 from which it overflows into the tub and collects in the bottom of the tub. The pump then circulates the water through the spray arm and back through the sump for a period of time sufficient to adequately wash and rinse the articles in the dishwasher. After each washing or rinsing operation is completed the water is discharged by the pump through a conduit 73.

While articles may be dried by merely circulating air thereover, dishwashers are frequently provided with a heating element for insuring complete drying of the articles washed therein. This heating element indicated at 74 in the drawing, is positioned near the bottom wall 75 of the dishwasher and air heated thereby flows upwardly to effect drying of the articles in the dishwasher. The heating element is conventionally of the sheathed type, such as that sold under the trademark Calrod ®.

The dishwasher has mounted within the door 4 a time cycle controller 53 used to institute an operational program which may include various washing and rinsing operations. The time cycle controller is activated by the user by turning the knob 52 protruding from the front of the dishwasher 4. When the dishwasher is loaded and a suitable quantity of detergent added, the door is closed and the user activates the time cycle controller to institute an operational program. During the washing and rinsing operations, the pump 60 forces water from the sump 66 up through the spray arm 64 which in turn sprays the articles within the tub. At the end of each washing and rinsing operation, the spent liquid is drained from the tub. After a suitable drain interval at the end of the final rinsing operation, the Calrod ® heating element 74 is energized to dry the washed articles by evaporation of the liquid remaining therein.

The addition of wetting agents and other additives to the final rinse water to improve the drainage of the rinse water from the items being washed is quite common since this minimizes the retention of small rinse water droplets on the washed items which, in turn, cause spotting due to mineral precipitation on evaporation of the droplets.

Figure 5:
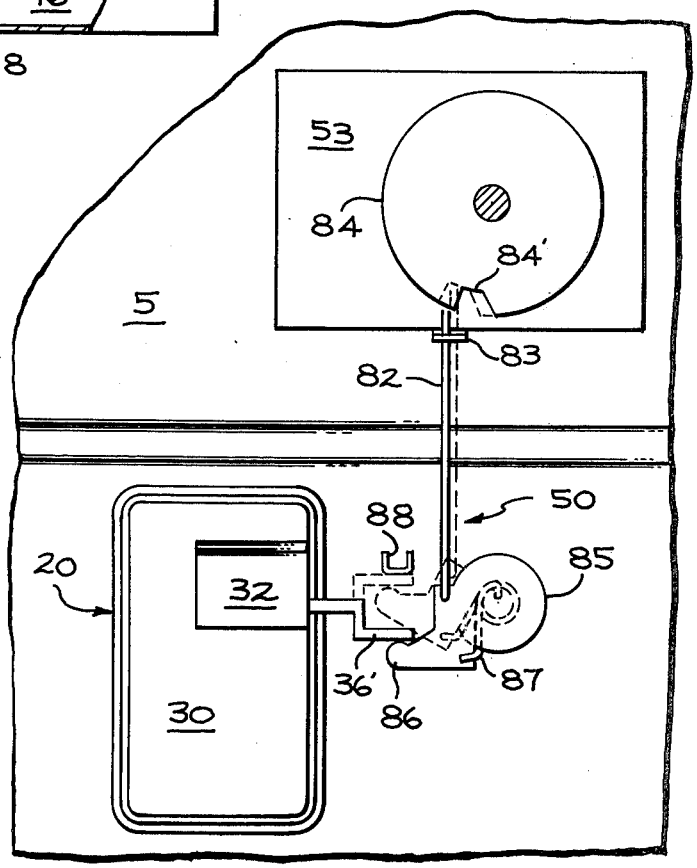
FIG. 5 is a fragmentary front plan view, of a dispenser according to this invention illustrating one method of actuating the measuring cup.

The present invention provides a means for adding such rinse additives in a manner such that undesirable leakage is virtually eliminated and a precise quantity of additive is delivered to the washing chamber at exactly the required time in the rinse portion of the cycle. As shown in FIGS. 1 and 5, the dispenser 20 comprises a generally rectangular container, arranged to be mounted within the dishwasher door 4. Advantageously, the dispenser can be designed to act as a stiffener between the inner and outer panel of the door 4 so as to prevent excessive deflection of the inner door panel in the event heavy articles are placed on the opened door. The dispenser may be mounted by any suitable means.

Figure 2:
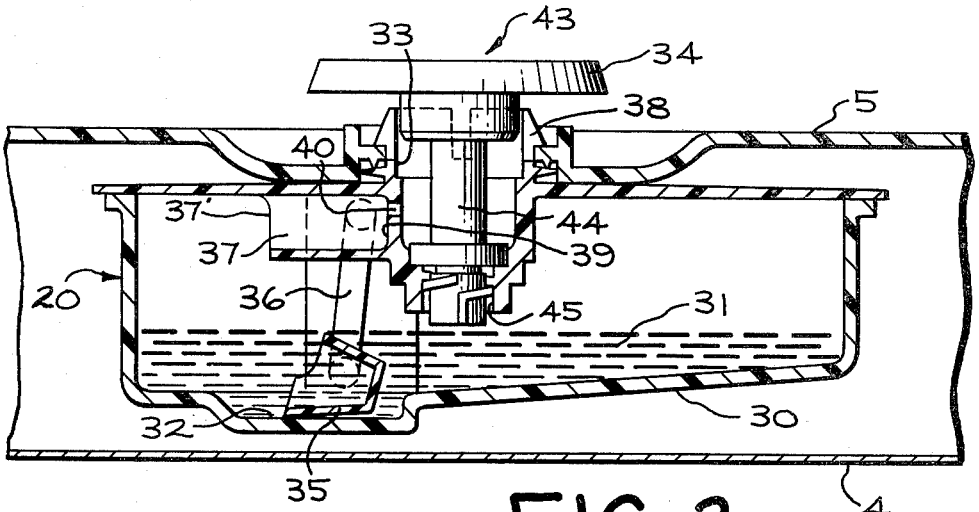
FIG. 2 is a section of the dispenser structure through the main body part, the measuring cup, the discharge conduit and exit port in the open door position.
Figure 3:
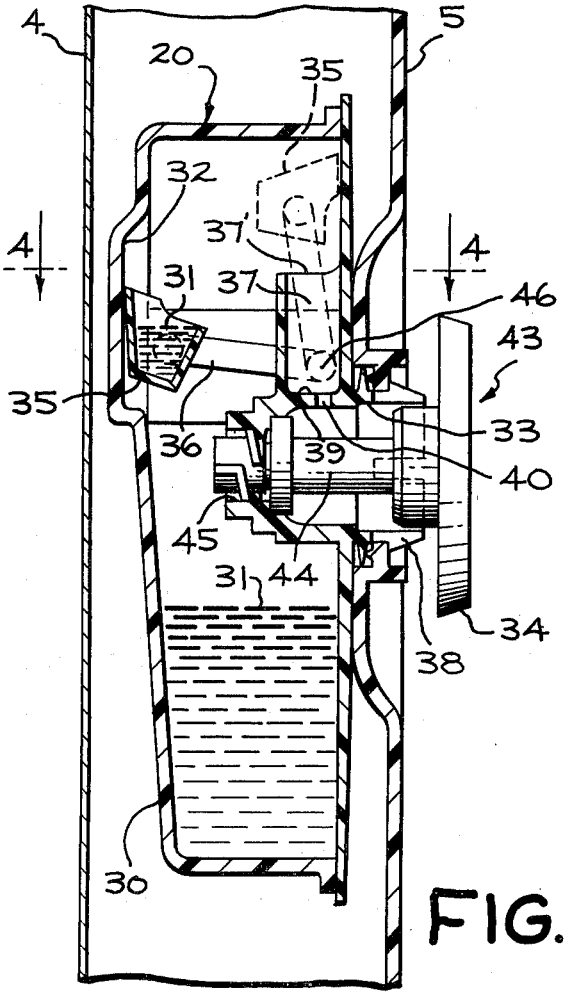
FIG. 3 is the same section as FIG. 2 above only in the door closed position.
Figure 4:
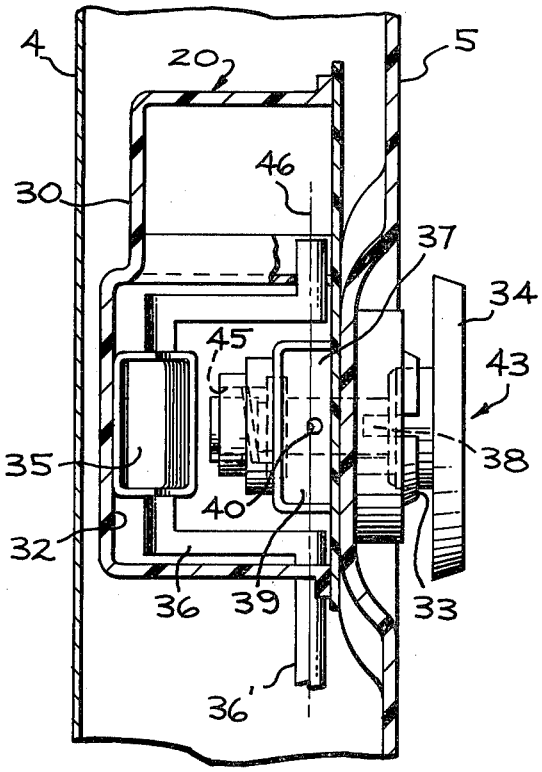
FIG. 4 is a section of the dispenser structure generally along section lines 4—4 FIG. 3.

The dispenser 20 is illustrated in cross section in FIG. 2, 3 and 4. As shown, the dispenser consists of a generally rectangular main body part 30 which defines a reservoir for the liquid additive 31. The main body part 30 contains a sump 32 located closest to the outer door panel such that when the dishwasher door 4 is in the open position, sump 32 is the lowest portion of the liquid additive reservoir defined by the main body part 30. The main body part 30 may be made of any suitable material but preferably would be a molded plastic impervious to the liquid additive and non-corroding as are the other parts of the dispenser.

Liquid additive is charged to the main body part 30 through fill opening 33 which protrudes through the inner panel 5 of the dishwasher door. The fill opening 33 is conveniently fitted with a closure device 43 to prevent leakage of water into body part 30 during operation of the dishwasher and to prevent leakage of additives into the dishwasher. Closure device 43 consists of elongated member 44 threadably and sealingly received within opening 45 of filling means 33. The opening 45 is appropriately located so that it is always above the liquid additive level whether the door be opened or closed so as to avoid any leakage of liquid additives into the washing chamber. Although only one closure device is shown it can be appreciated that other devices could also be employed. For example, if member 44 were hollow and formed as part of discharge conduit 37, the top 34 of member 44 could be configured to sealingly snap into the hollow section of member 44 after reservoir 30 has been charged with additives. It should also be understood that although the discharge conduit 37 and the filling means 33 are shown as being formed from the same piece, the discharge conduit 37 could be completely separate and spaced from the filling means 33.

The measuring and dispensing device is located within the confines of main body part 30. In its broadest terms, it consists of a measuring cup 35 which is of predetermined size and rotatably mounted for movement between a filling and discharge position by means of a pivot arm 36. In the filling position, measuring cup 35 is positioned within the sump 32 and is submerged in liquid additive 31 when the dishwasher door 4 is in the open position (see FIG. 2). Upon closing the dishwasher door 4, the main body part 30 is rotated through approximately 90° which causes the liquid additive in sump 32 to flow therefrom to the now lower portion of main body part 30 (see FIG. 3). At this point, measuring cup 35 remains in the fill or normal position, contains a precise quantity of liquid additive, and is above the level of the liquid additive of the reservoir in the main body part 30.

At the proper preselected time in the wash cycle, the measuring cup 35 is caused to move to its discharge position (see dotted line position of meausring cup, FIG. 3), discharge a precise quantity of liquid additive, and return to the fill position within sump 32. The means for moving measuring cup 35 between its fill and discharge positions can be of any conventional design, but preferably the means should be as simple as possible so as to achieve both economic and long lasting benefits. For example, actuating means 50 is shown in FIG. 5 comprising a cam follower 82 slidably received in slotted member 83 and tangentially engaging cam member 84 which is rotatably attached to the time cycle controllr 53. The other end of cam follower 82 is fixedly engaged for movement with member 85 having a projection 86 thereon to engage an extension 36' of pivot arm 36 (see also FIG. 4). Member 85 is spring biased by resilient member 87 for rotation in a clockwise direction. At the appropriate time in the operational cycle cam follower 82 will slide into the recessed surface 84' of cam member 84 causing extension 86 to rotate arm extension 36' of pivot arm 36 into engagement with the stop member 88 as is shown in phantom. Referring to FIG. 3, it can be seen that the rotation of pivot arm 36 causes the cup member 35 to be canted upwardly thereby positioned over discharge conduit 37 for emptying. It is preferred to mount measuring cup 35 to pivot arm 36 which rotates about axis 46 (shown in FIG. 4) remote from the measuring cup 35 effectively controlling the movement between the fill and discharge positions.

Preferably, the measuring cup 35 is fixedly attached to the pivot arm 36 so that pivoting of the pivot arm 36 automatically pivots the measuring cup 35 thereby causing a precise quantity of liquid additive to be discharged into the discharge conduit 37 when the cup is rotated to the discharge position.

At the discharge position the precise quantity of liquid additive is discharged by gravity from measuring cup 35 into discharge conduit 37 through which the liquid additive flows by gravity to exit port 38 of fill opening 33 and thence into dishwasher tub 15. Discharge conduit 37 is a generally elongated stationary structure in substantially a vertical position when the dishwasher door is closed. In this position the upper end of discharge conduit 37 has an opening to receive the liquid additive discharged from the measuring cup. The interior lower end portion of the discharge conduit 37 is open to fill opening 33 which in turn is in communication with the interior of the washing chamber through exit port 38. Flow through the discharge conduit is by gravity and the discharge conduit is sufficiently elongated so as to prevent any water which might enter exit port 38 from the washing chamber during the washing cycle from splashing up through the upper aperture in the discharge conduit and into the reservoir of liquid additives. In this regard, the discharge conduit 37 might also have a restricted portion intermediate the ends thereof to help prevent leakage through splashing from the washing chamber into the liquid additive reservoir. The drawings illustrate this restriction by cylindrical wall 39 having small aperture 40 therethrough located between the upper opening of the discharge conduit and exit port 38. This effectively eliminates the possibility of leakage into the liquid additive reservoir. It should be noted that the top 37' of discharge conduit 37 is positioned so as to always be above the level of the liquid additive in the main body part 30 regardless of the door position. This of course eliminates all possibility of leakage of liquid additive into the washing chamber.

In the foregoing description of the present invention, the movement of the measuring cup 35 on pivot arm 36 between a filling and discharge position in timed relationship with the washing cycle in response to the actuating means 50 has been described. However, one skilled in the art will appreciate that any known mechanism for causing pivot arm 36 to pivot could be utilized. Typical mechanisms would be pistons, cam linkages or the like made operable by a time controller such as that shown. Such electro-mechanical time cycle controllers are well known in the field and are presently employed on most dishwashers today. In any event, a simple mechanical means should be used to assure consistent trouble-free operation over a longer period of time, while the fewer parts produce a dispenser of substantial savings over those in current use.

Referring specifically to FIG. 2, the user will be instructed when filling the reservoir 30 that the reservoir is full when the additive level 31 reaches the fill opening 45. Through the appropriate sizing of the container 30 and the proper placement of fill means 33 and discharge conduit 37 within container 30, the additive level 31 will always be below the entry 37' of discharge conduit 37 regardless of the attitude of the door 4.

While the instant invention has been described with regard to a liquid additive, it would also be applicable to solids in particulate form. In metering solids into a washing apparatus, however, it would be desirable to intermittently operate a water purge line in the discharge conduit to sweep all supplied particulate additives into the washing chamber thereby avoiding caking of the solid within the discharge conduit.

The foregoing disclosure of specific embodiment is illustrative of the broad inventive concepts comprehended by the present invention.

What is claimed is:

1. An additive dispenser for use in washing apparatus such as a dishwasher having a front opening door pivotable between a vertical closed position and a generally horizontal open position, the dispenser comprising:

container means mounted on the door having a portion serving as an additive storage reservoir, said container means having fill means including a closure device for inserting additive into the container when the door is in the open position, and having discharge means communicating with the interior of the dishwasher when the door is in the closed position, said discharge means including an elongated discharge conduit located in the interior of the container and having an entry opening therein, said container means further housing a sump defining the lowermost portion of the container when said door is in its open postion;

additive measuring and dispensing means movably mounted within the container and operable between a first position, relative to said door, within said sump, said measuring and dispensing means being immersed in the additive of the container when said measuring and dispensing means is in said first position and said door is in said open postion, said measuring and dispensing means being thereby filled with additive, said additive being retained by said measuring and dispensing means as said door moves to said closed position, and a second position, relative to said door, remote from said sump over the entry opening of the discharge means, said measuring and dispensing means being canted such that when the door is in said closed position the additive is caused to flow from the measuring and dispensing means into the discharge conduit and then out into the dishwasher; and actuating means for moving the dispenser means from said first to said second position at a predetermined time in the operating cycle of the dishwasher.

2. The dispenser of claim 1 wherein said discharge means is in additive flow communication with said fill means, said fill means having an exit port therein through which the additive flows into the dishwasher.

3. The dispenser of claim 1 wherein said measuring and dispensing means comprises a cup member of predetermined size fixedly attached to a pivot member, said cup disposed so as to fill when in said first position, said cup remaining filled when the door is closed.

4. The dispenser of claim 3 wherein said cup and said pivot member are pivotable about a point remote from said cup when moved between said first and second positions.

5. The dispenser of claim 1 wherein the discharge conduit has restriction means intermediate said entry and the interior of the dishwasher.

6. The dispenser of claim 1 wherein said closure device comprises an elongated member threadably received within said fill means, said member being removable so that additive may be inserted into said reservoir through said threaded opening of said fill means, said threaded opening being sealed from the interior of the dishwasher when said member is threaded into said opening.

* * * * *